US008052473B2

(12) United States Patent
Chiang et al.

(10) Patent No.: US 8,052,473 B2
(45) Date of Patent: Nov. 8, 2011

(54) ELECTRICAL CONNECTOR WITH ELECTROSTATIC PROTECTION

(75) Inventors: Shu-Man Chiang, Taipei (TW); Sheng-Nan Yu, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 48 days.

(21) Appl. No.: 12/717,959

(22) Filed: Mar. 5, 2010

(65) Prior Publication Data

US 2011/0217872 A1 Sep. 8, 2011

(51) Int. Cl.
*H01R 9/03* (2006.01)

(52) U.S. Cl. ..... 439/607.41; 439/638; 439/928

(58) Field of Classification Search ..... 439/607.41, 439/638, 717, 716, 59, 928
See application file for complete search history.

(56) References Cited

U.S. PATENT DOCUMENTS

| | | | | |
|---|---|---|---|---|
| 4,857,016 | A * | 8/1989 | Benscoter et al. | 439/680 |
| 4,894,630 | A * | 1/1990 | Ueta et al. | 333/185 |
| 5,340,333 | A * | 8/1994 | Schroth | 439/607.25 |
| 6,176,743 | B1 * | 1/2001 | Kuo | 439/638 |
| 6,887,108 | B2 * | 5/2005 | Wu | 439/638 |
| 7,497,738 | B2 * | 3/2009 | Kuo | 439/638 |
| 7,500,880 | B1 * | 3/2009 | Vaziri et al. | 439/638 |

* cited by examiner

*Primary Examiner* — Hae Moon Hyeon

(57) ABSTRACT

An electrical connector includes an insulating housing defining two openings, a circuit board received in the insulating housing and formed with two sets of contacts, a cover covering the insulating housing and enclosing the circuit board except the sets of contacts, and a pair of grounding shells inserted into the openings respectively. Each of the grounding shells defines an inserting opening exposed through the opening of the insulating housing and a blocking opening received in the insulating housing. One of the grounding shells connects to a grounding unit of a cord telephone base, and the other grounding shell connects to a grounding unit of a portable wireless telephone to prevent the cord telephone base and the portable wireless telephone from electrostatic influence.

13 Claims, 5 Drawing Sheets

ELECTRICAL CONNECTOR WITH ELECTROSTATIC PROTECTION

BACKGROUND OF THE INVENTION

1. Field of the Invention

The present invention relates to an electrical connector, more specifically, to an electrical connector with electrostatic protection.

2. The Related Art

A Wireless telephone system is popular nowadays, which has a cord telephone base and a portable wireless telephone (not shown in figures). The cord telephone base links to a telephone switch center by a telephone cord. If the portable wireless telephone is used, the portable wireless telephone can link the cord telephone base by radio. If the energy of a rechargeable battery of the portable wireless is insufficient, it can be connected to the cord telephone base by an electrical connector for being charged.

Please refer to FIG. 5, a conventional electrical connector 900 adapted to interconnect the cord telephone base and the portable wireless telephone includes an insulating housing 902, a printed circuit board 904 and a cover 906. The printed circuit board 904 includes two sets of contacts 908 defined at opposite ends thereof.

The cover 906 defines two positioning recesses 910. The printed circuit board 904 is received in the insulating housing 902. The cover 906 covers on the insulating housing 902 and encloses the printed circuit board 904. The sets of contacts 908 are exposed through the positioning recesses 910 respectively. The sets of contacts 908 respectively connect the cord telephone base and the portable wireless telephone. Hence, the portable wireless telephone will be charged through the electrical connector 900.

However, if the portable wireless telephone is hold by a human hand to be mounted on or apart form the cord telephone base, the static electricity of the human hand will influence electrical elements configured in the cord telephone base. Hence, the electrical elements of the cord telephone base will be damaged by the static electricity.

SUMMARY OF THE INVENTION

An object of the present invention is to provide an electrical connector.

According to the invention, the electrical connector includes an insulating housing, a circuit board, a cover and a pair of grounding shells. The insulating housing defines two openings. The circuit board is received in the insulating housing and formed with two sets of contacts. The cover covers the insulating housing and encloses the circuit board except the sets of contacts being exposed through the cover.

The grounding shells are connected to each other. Each of the grounding shells is inserted into each of the openings of the housing. Each of the grounding shells defines an inserting opening exposed through the opening of the housing and a blocking opening received in the insulating housing.

If the electrical connector is in use, one set of the contacts connects to a circuit of a cord telephone base, and the other set of the contacts connects to a circuit of a portable wireless telephone for transmitting a signal and a charging energy. One of the grounding shells connects to a grounding unit of the cord telephone base, and the other of the grounding shells connects to a grounding unit of the portable wireless telephone to prevent the cord telephone base and the portable wireless telephone from electrostatic influence.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
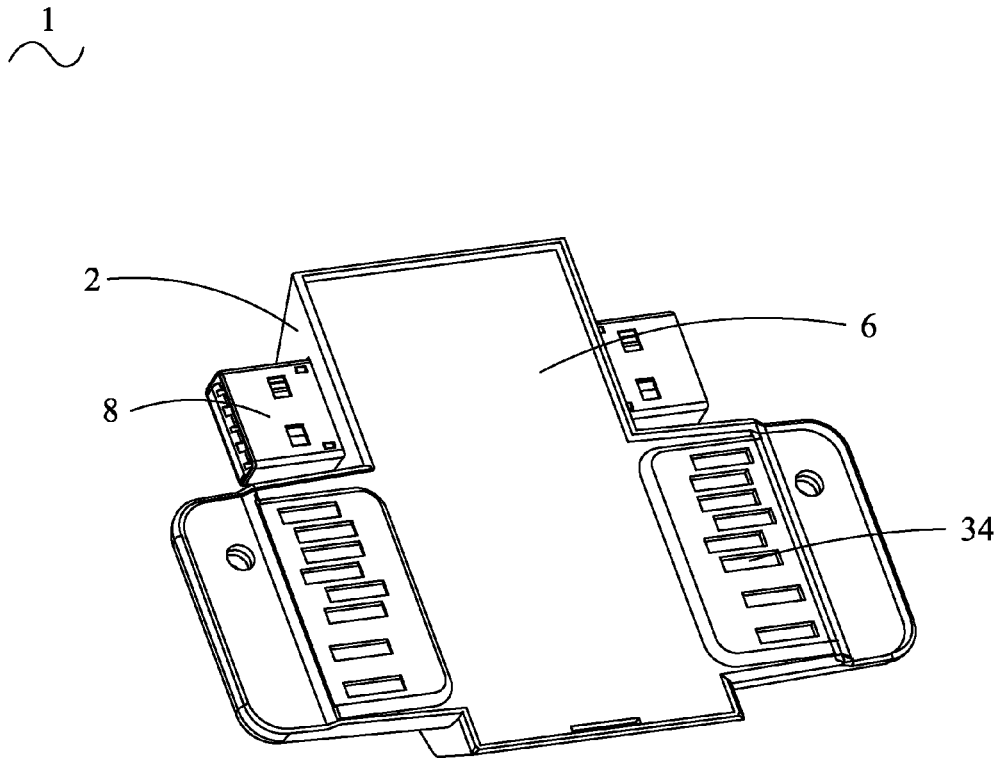
FIG. 1 is a perspective view of an electrical connector according to the present invention.
Figure 2:
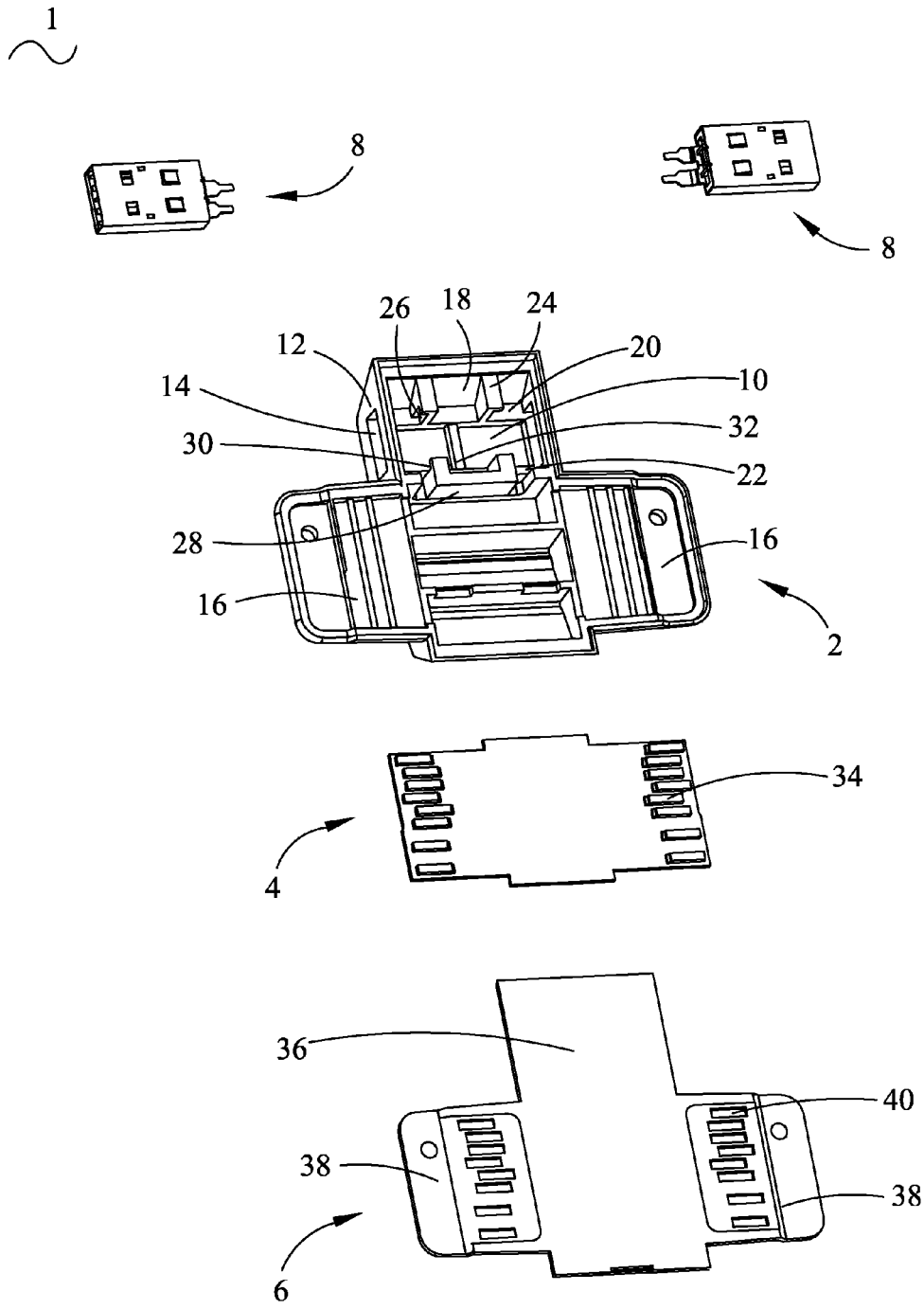
FIG. 2 is an exploded view of the electrical connector in FIG. 1.

Please refer to FIG. 1 and FIG. 2. An electrical connector 1 according to the present invention includes an insulating housing 2, a printed circuit board 4, a cover 6 and a pair of grounding components 8. The insulating housing 2 includes an elongate bottom wall 10, a pair of side walls 12 extending upward from opposite sides of the bottom wall 10, a pair of openings 14 defined at a rear portion of the side walls 12 respectively, a pair of wings 16 extending laterally from a top of a front portion of the side walls 12, a rear wall 18 extending upward from a rear end of the bottom wall 10 and interconnected with the side walls 12, and a front wall extending upward from a front end of the bottom wall 10 and interconnected with the side walls 12.

A first supporting rib 20 is transversely protruded from a corner where an inner surface of the bottom wall 10 connected to an inner surface of the rear wall 18. A second supporting rib 22 is transversely protruded from a middle portion of the inner surface of the bottom wall 10. Especially, the first supporting rib 20 and the second supporting rib 22 respectively interconnect the side walls 12. The top surfaces of the first supporting rib 20 and the second supporting rib 22 and a bottom of each opening 14 are at the same level.

The top surface of the first supporting rib 20 is extended upward to form a pair of blocking walls 24. The blocking walls 24 are separated from each other. A bottom portion of each blocking wall 24 defines a first positioning recess 26 facing the side wall 12. A middle portion of the top surface of the second supporting rib 22 is extended upward to form a blocking block 28. A second positioning recess 30 is defined at each lateral side of the blocking block 28 and faced the side wall 12.

A connecting rib 32 is protruded from the inner surface of the bottom wall and along a longitudinal direction of the bottom wall 10. The connecting rib 32 is arranged between the first supporting rib 20 and the second supporting rib 22, and interconnected with a middle of the first supporting rib 20 and a middle of the second supporting rib 22.

The printed circuit board 4 is formed as an elongate shape. Each of opposite ends of the printed circuit board 4 is formed with a set of contacts 34. The cover 6 is formed of an inverted-T shape and includes an elongate main plate 36 and a pair of wing plates 38 laterally extending from a front portion of each side edge of the elongate main plate 36. Each wing plate 38 defines a set of contact openings 40. The dimension of the contact openings 40 matches with the contacts 34.

Figure 3:
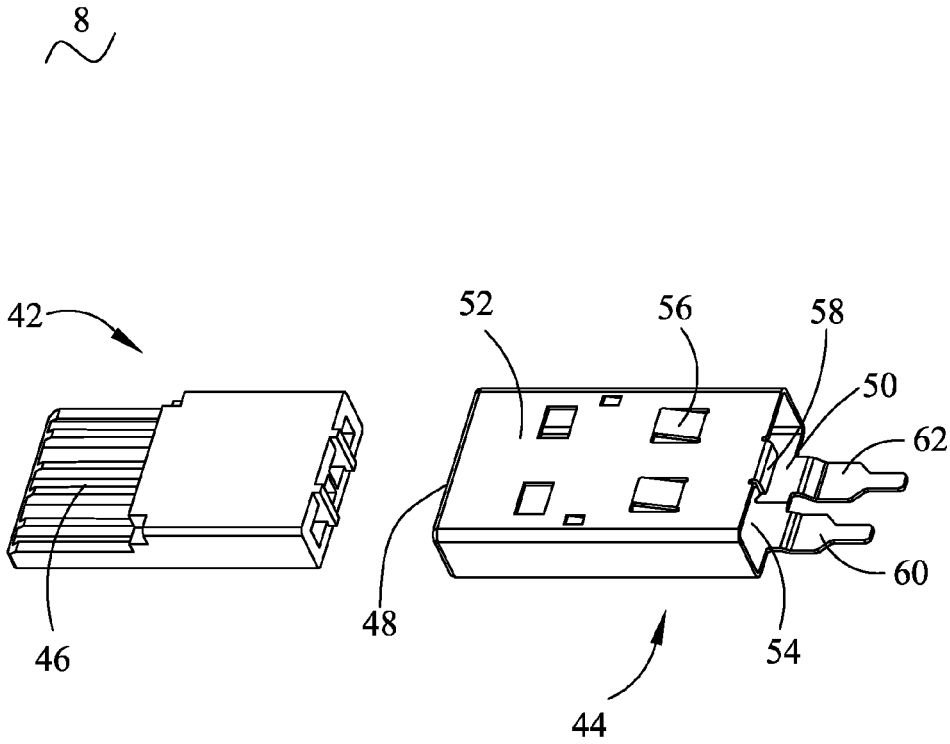
FIG. 3 is an exploded view of a grounding component of the electrical connector in FIG. 2.
Figure 4:
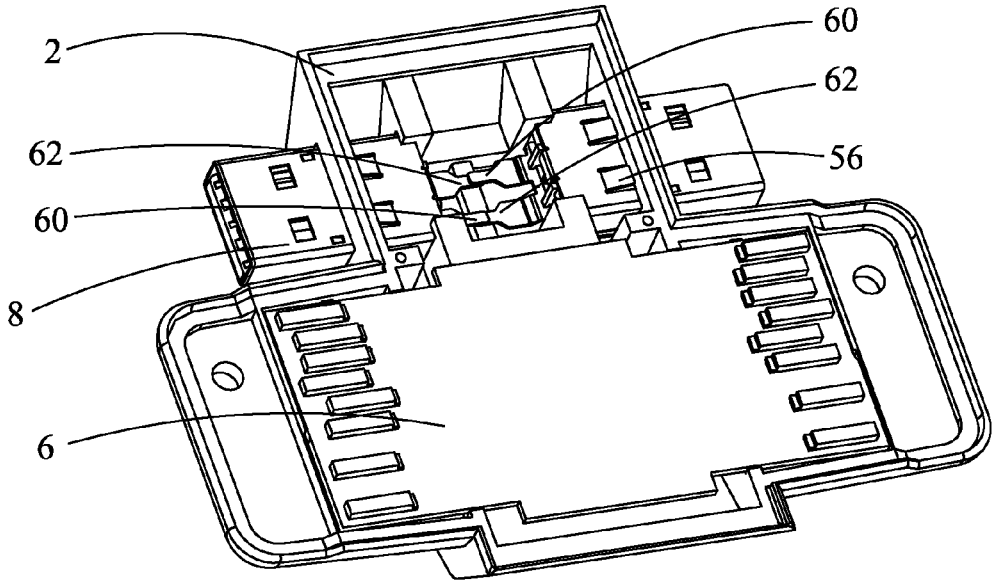
FIG. 4 is a perspective view of the electrical connector without a cover in FIG. 1.
Figure 5:
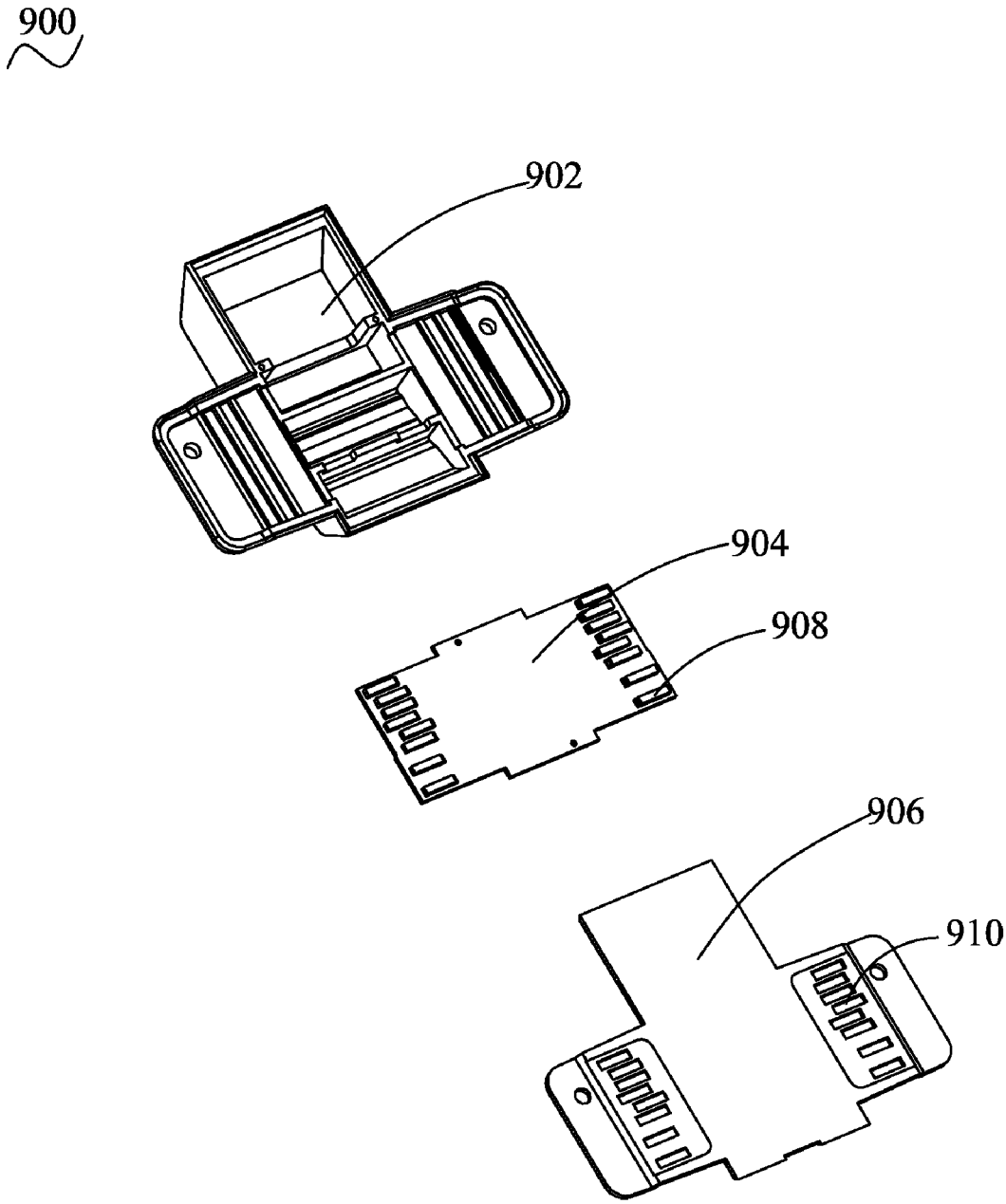
(Prior Art) FIG. 5
FIG. 5 is a perspective view of a conventional electrical connector.

Please refer to FIG. 3. Each grounding component 8 includes an insulating body 42 and a grounding shell 44. The insulating body 42 defines an inserting portion 46 at one end thereof and a blocking portion at the other end thereof. The grounding shell 44 is formed as an elongate sleeve shape to define an inserting opening 48 at one end thereof and a blocking opening 50 at the other end thereof. The grounding shell 44 encloses the insulating body 42 and includes a top plate 52, a bottom plate 54 and opposite side plates interconnected with the top plate 52 and the bottom plate 54.

The top plate 52 and the bottom plate 54 of the grounding shell 44 are respectively punched to form a pair of wedges 56 (only shown the wedges of the top plate). The top plate 52 is extended downward to form a blocking tab 58 from the edge of the blocking opening 50 thereof. The blocking tab 58 is vertical to the top plate 52 and positioned at the blocking opening 50. The bottom plate 54 is extended downward and then outward along a longitudinal direction of the grounding shell 44 from the edge of the blocking opening 50 thereof to form a first soldering leg 60 and a second soldering leg 62 apart from the first soldering leg 60. Especially, a bottom surface of the first soldering leg 60 and a top surface of the second soldering leg 62 are at the same level.

Please refer to FIG. 1 to FIG. 4. If the grounding component 8 is assembled, the insulating body 42 is inserted into the grounding shell 44 from the inserting opening 48. The inserting portion 46 of the insulating body 42 is aligned with the inserting opening 48 of the grounding shell 44. The blocking portion of the insulating body 42 is abutted against the blocking tab 58 of the grounding shell 44. Hence, the insulating body 42 is blocked by the blocking tab 58 to position in the grounding shell 44.

If the electrical connector 1 is assembled, the grounding components 8 will be inserted into the insulating housing 2 through the openings 14 respectively. The inserting portion 46 of the insulating body 42 and the inserting opening 48 of the grounding shell 44 are projected from the opening 14. The wedges 56 of the grounding shell 44 abut against the inner periphery of the opening 14 to prevent the grounding component 8 apart from the insulating housing 2. The grounding shell 44 is supported by the first supporting rib 20 and the second supporting rib 22.

Hence, the first soldering legs 60 and the second soldering legs 62 of the grounding components 8 are positioned in the insulating housing 2. The edges of the blocking openings 50 of the grounding shells 44 of the grounding components 8 are engaged into the first positioning recesses 26 of the blocking walls 24 and the second positioning recesses 30 of the blocking block 28.

The first soldering leg 60 and the second soldering leg 62 of one of the grounding component 8, and the first soldering leg 60 and the second soldering leg 62 of the other grounding component 8 are staggered. Hence, the first soldering leg 60 of one of the grounding component 8 is attached on the second soldering leg 62 of the other grounding component 8. Especially, the first soldering leg 60 will firmly attach on the soldering leg 62 by soldering. The first soldering legs 60 and the second soldering legs 62 are supported by the connecting rib 32.

The printed circuit board 4 is transversely received in the front portion of the insulating housing 2. The sets of contacts 34 formed at the ends of the printed circuit board 4 are positioned at the wings 16 of the insulating housing 2 respectively. The cover 6 covers on the insulating housing 2 and encloses the printed circuit board 4. The sets of contacts 34 are exposed through the sets of contact openings 40 of the cover 6.

If the electrical connector 1 is in use, one set of contacts 34 of the printed circuit board 4 will connect to a circuit of a cord telephone base, and the other set of contacts 34 will connect to a circuit of a portable wireless telephone. Hence, the printed circuit board 4 can transmit a signal and a charging energy from the cord telephone base to the portable wireless telephone. One of the grounding components 8 will connect to a grounding unit of the cord telephone base, and the other grounding component 8 will connect to a grounding unit of the portable wireless telephone to prevent the cord telephone base from electrostatic influence.

Furthermore, the present invention is not limited to the embodiments described above; diverse additions, alterations and the like may be made within the scope of the present invention by a person skilled in the art. For example, respective embodiments may be appropriately combined.

What is claimed is:

1. An electrical connector, comprising:

an insulating housing defining at least two openings;

a circuit board received in the insulating housing and formed with at least two sets of contacts;

a cover covering the insulating housing and enclosing the circuit board except the at least two sets of contacts being exposed through the cover; and a pair of grounding shells respectively inserted into the insulating housing through the openings, each of the grounding shells defining an inserting opening exposed through the opening of the insulating housing, and a blocking opening received in the insulating housing, the grounding shells electronically connected to each other.

2. The electrical connector as claimed in claim 1, wherein each of the grounding shells comprises a first soldering leg and a second soldering leg extending from an edge of the blocking opening thereof, the first soldering leg and the second soldering leg of one of the grounding shells connect to the first soldering leg and the second soldering leg of the other grounding shell.

3. The electrical connector as claimed in claim 2, wherein a bottom surface of the first soldering leg and a top surface of the second soldering leg are at the same level, the first soldering leg of one of the grounding shells is attached upon the second soldering leg of the other grounding shell.

4. The electrical connector as claimed in claim 3, wherein each of the grounding shells comprises a pair of wedges abutted against the inner periphery of each opening.

5. The electrical connector as claimed in claim 4, wherein each of the grounding shells comprises a top plate, a bottom plate and opposite side plates interconnected with the top plate and the bottom plate, the wedges are formed at the top plate, and the first soldering leg and the second soldering leg are extended from the bottom plate at the edge of the blocking opening.

6. The electrical connector as claimed in claim 5, wherein the top plate is extended downward from the edge of the block opening to form a blocking tab.

7. The electrical connector as claimed in claim 6, further comprising an insulating body received in the grounding shell and formed with an inserting portion aligned with the inserting opening of the grounding shell, the insulating body inserted into the grounding shell and blocked by the blocking tab.

8. The electrical connector as claimed in claim 7, wherein the insulating housing comprises a bottom wall, a pair of side walls extended upward from opposite sides of the bottom wall, a rear wall and a front wall opposite to the rear wall, and each of the openings is defined at a rear portion of each side wall.

9. The electrical connector as claimed in claim 8, wherein an inner surface of the bottom plate of the insulating housing is transversely protruded to form a first supporting rib and a second supporting rib for supporting the grounding shells.

10. The electrical connector as claimed in claim 9, wherein an inner surface of the bottom plate of the insulating housing is longitudinally protruded to form a connecting rib interconnecting between the first supporting rib and the second supporting rib for supporting the first soldering legs and the second soldering legs of the grounding shells.

11. The electrical connector as claimed in claim 10, wherein the first supporting rib is extended upward to form a pair of blocking walls abutted against the edges of the blocking openings of the grounding shells respectively for positioning the grounding shells, and the second supporting rib is extended upward to form a blocking block for positioning the grounding shells.

12. The electrical connector as claimed in claim 11, wherein the second supporting rib is extended upward to form a blocking block abutted against the edges of the blocking openings of the grounding shells for positioning the grounding shells.

13. The electrical connector as claimed in claim 12, wherein each of the blocking walls defines a first positioning recess facing the side wall for engaging with the edge of the blocking opening of the grounding shell, and the blocking block defines a pair of second positioning recesses respectively facing the side walls for engaging with the edges of the block openings of the the grounding shells respectively.

* * * * *